US006716055B1

(12) United States Patent
Echito

(10) Patent No.: US 6,716,055 B1
(45) Date of Patent: Apr. 6, 2004

(54) ELECTRICAL CONNECTOR FOR CONNECTING A BRANCHED CIRCUIT TO A MAIN POWER SOURCE

(75) Inventor: Cory Echito, Mahwah, NJ (US)

(73) Assignee: American Tack & Hardware Co., Inc., Monsey, NY (US)

( * ) Notice: Subject to any disclaimer, the term of this patent is extended or adjusted under 35 U.S.C. 154(b) by 0 days.

(21) Appl. No.: 10/303,476

(22) Filed: Nov. 25, 2002

(51) Int. Cl.[7] ..... H01R 11/20
(52) U.S. Cl. ..... 439/417; 439/419
(58) Field of Search ..... 439/417, 418, 439/419, 425, 426, 404–410

(56) References Cited

U.S. PATENT DOCUMENTS 4,159,157 A * 6/1979 Koehler ..... 439/419 X
5,556,297 A * 9/1996 Bray et al. ..... 439/405
5,959,394 A * 9/1999 Lin ..... 439/419 X

* cited by examiner

*Primary Examiner*—Lynn Feild
*Assistant Examiner*—Son V. Nguyen
(74) *Attorney, Agent, or Firm*—Hedman & Costigan, P.C.

(57) ABSTRACT

An electrical connector which includes a base member having a first channel for a dual conductor main power cord and a top member having a second channel for a dual conductor branched circuit power cord, the first channel comprising a space which is adapted to confine the dual conductors of said main power cord while maintaining a space between the conductors of said dual conductor main power cord and the second channel comprising means to hold said dual conductor branched circuit power cord at an angle to said first channel, said connector also including two electrically conductive bus bars fitted into retaining means in said top member, said bus bars having at each end a piercing element adapted to penetrate the electrical insulation of a power cord to provide an electrical connection between said main power cord and said branched circuit power cord; and a retainer means which is sized to engage a channel in said top member to force said branched power cord against said bus bars to establish and maintain electrical conductivity between said main power cord and said branched circuit power cord.

5 Claims, 7 Drawing Sheets

ELECTRICAL CONNECTOR FOR CONNECTING A BRANCHED CIRCUIT TO A MAIN POWER SOURCE

BACKGROUND OF THE INVENTION

The present invention is concerned with a connector which allows for the connection of a branched circuit to a dual lead electrical cord without the need to cut the electrical cord. It is contemplated that the principal application for the connector of the invention will be in electrical lighting systems that are used for household safety and decorative lighting.

Many connectors have been described in the prior art for use in making branched circuits from an electrical cord. U.S. Pat. No. 5,601,448 discloses a connector which has a base with two opposed sections that define a channel for receiving a dual lead electrical cord. The distal ends of the each section of the base have a threaded cap which presses the cord into piercing engagement with a pair of nails in the channel. Passages are provided in the base for the split ends of a cord for connecting and holding the split ends in electrical contact with the nails. This device requires the use of threaded set screws to hold the nails in fixed contact with the split ends of the cord.

U.S. Pat. No. 5,888,090 provides a connector that is intended for use in a lighting system for decorative miniature houses and village displays. The connector of U.S. Pat. No. 5,888,090 has a base element which has half-round channels to receive a dual lead electrical cord and holes which extend into the base in a transverse orientation to the half-round channels. Slits are provided in the base which extend under one-half of each channel to receive metal piercing elements which are adapted to pierce the insulation of an electrical connector and provide an electrical connection between separate conductor elements. A top element, having complimentary half-round channels, engages the base to press the electrical cord conductors onto the metal piercing elements. The metal piercing elements or blades are held by a friction fit and may make electrical contact on the sides of the base with conductors, foils or other grounded objects. In addition this device is only useful for rounded electrical power cords and not for power cords having a flat profile.

Accordingly a need exists for a simple to use, fully insulated connector which allows a branched circuit to be quickly connected to a dual conductor power cord.

SUMMARY OF THE INVENTION

The invention provides an electrical connector having a base member having a first channel for a dual conductor main power cord and a top member having a second channel for a dual conductor branched circuit power cord, the first channel comprising a divider which is adapted to fit between the dual conductors of said main power cord to maintain a space between the conductors of said dual conductor main power cord and the second channel comprising means to hold said dual conductor branched circuit power cord in a substantially transverse direction to said first channel, said connector also including two electrically conductive bus bars fitted into retaining means in said top member, said bus bars having at each end a piercing element adapted to penetrate the electrical insulation of a power cord to provide an electrical connection between said main power cord and said branched circuit power cord; and a retainer means which is sized to engage a channel in said top member to force said branched power cord against said piercing elements of said bus bars to establish and maintain electrical conductivity between said main power cord and said branched circuit power cord.

Accordingly, it is a primary object of the invention to provide a fully insulated electrical connector which may be used to tap a branched circuit off of a power cord without severing the conductors and without removing the insulation of any part of the conductors of the branched circuit.

It is also an object of this invention to provide a fully insulated electrical connector which securely holds the main electrical power cord and the branched circuit power cord.

It is also an object of this invention to provide a fully insulated electrical connector which securely holds the main electrical power cord and the branched circuit power cord and provides a means to mount the connector to a surface.

It is also an object of this invention to provide an electrical conductive bus bar having ends which are adapted to contact a portion of the circumference of electrical conductors in order to provide a secure electrical connection between the main power cord and the branched circuit power cord.

It is also an object of this invention to provide in the novel electrical connector, means for mounting the electrical connector to a surface. These and other objects of the invention will become apparent from a review of the specification.

DESCRIPTION OF THE PREFERRED EMBODIMENTS

Figure 1:
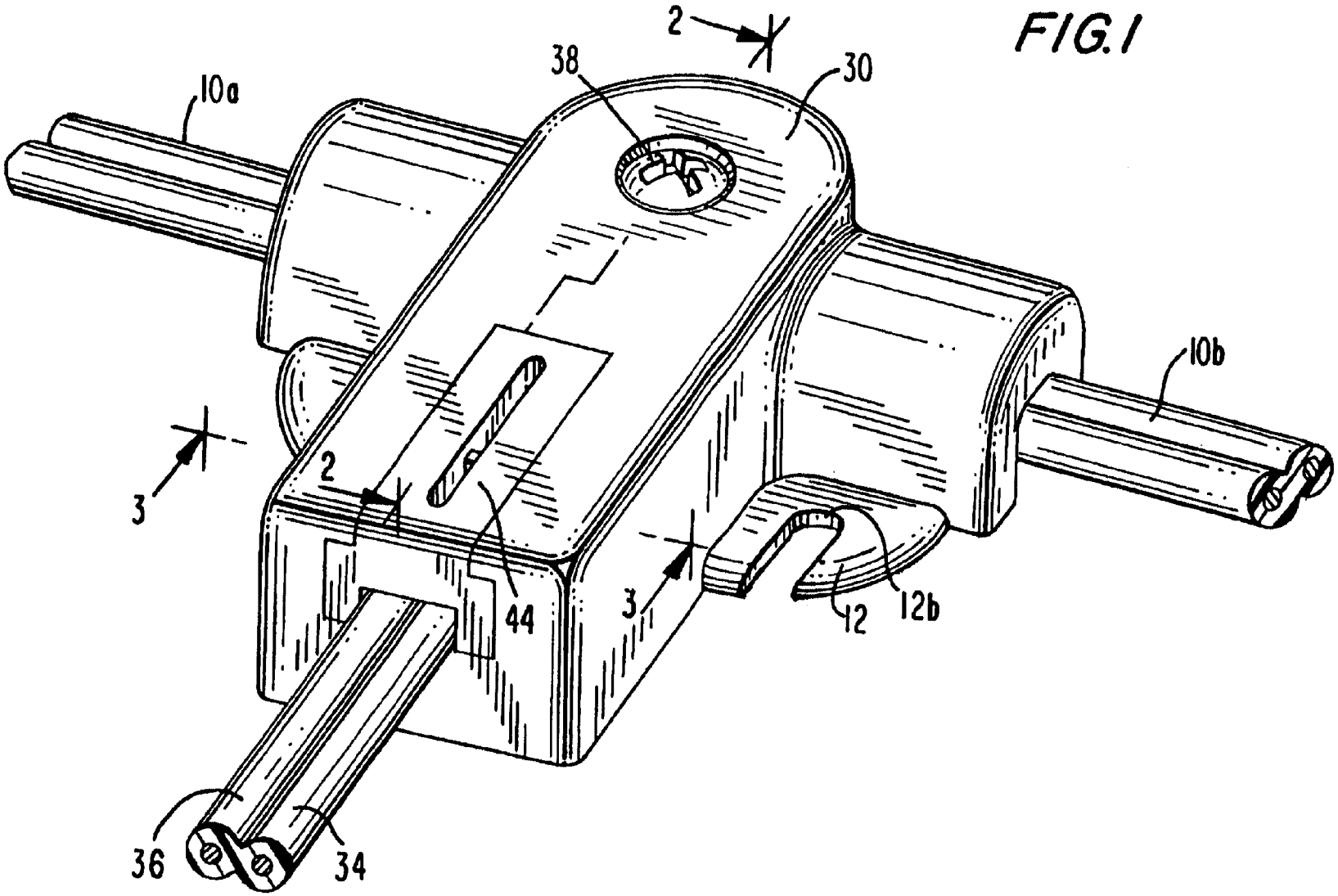
FIG. 1 is a perspective view of the assembled connector of the invention with a power cord and a branched circuit cord in place.
Figure 2:
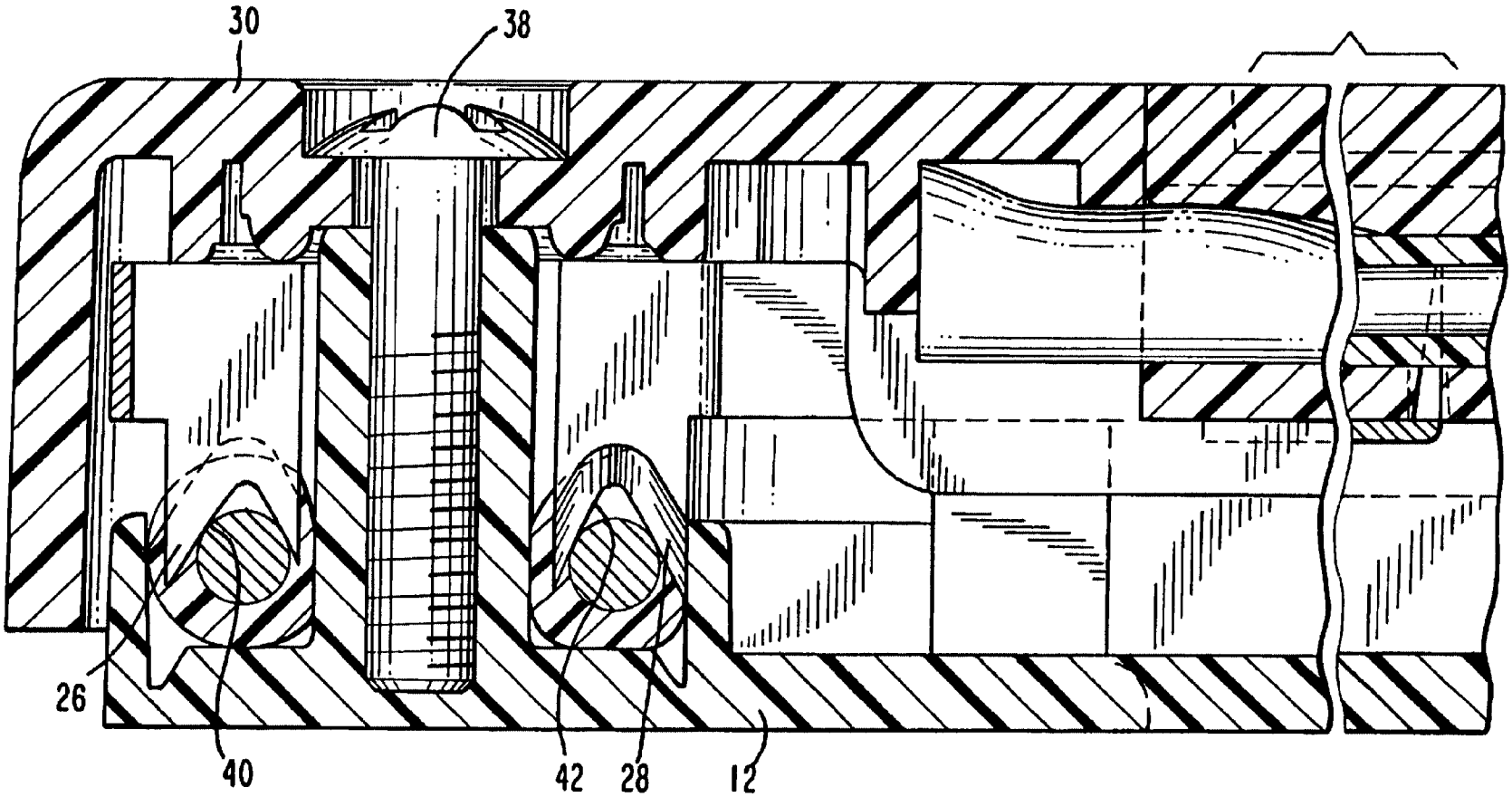
FIG. 2 is a cutaway view of FIG. 1 along lines 2—2.
Figure 4:
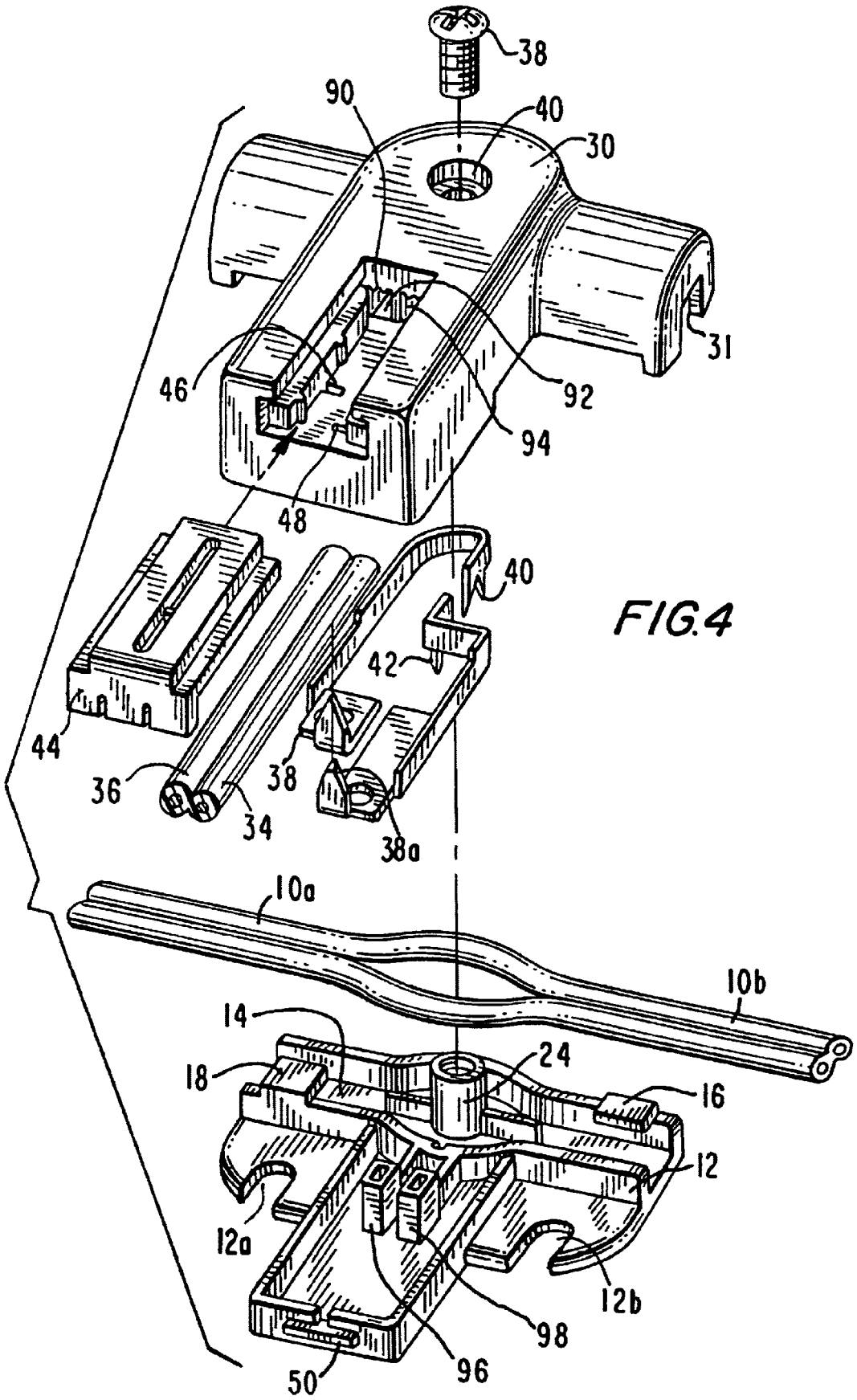
FIG. 4 is an exploded view of the base member, top member, bus bars retainer means with the main and branched circuit leads.
Figure 6:
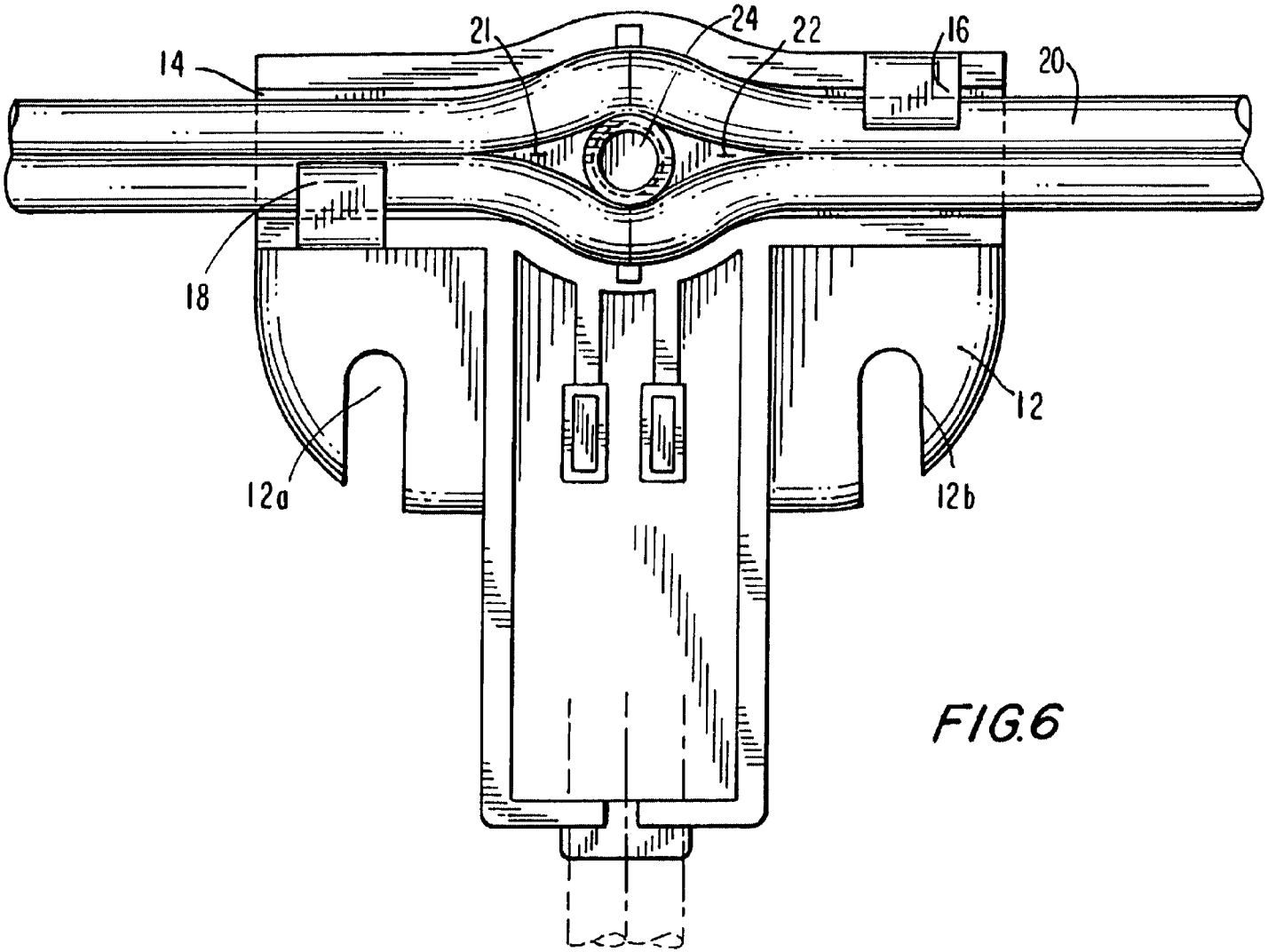
FIG. 6 is a top view of the base member with the main circuit conductor in place.
Figures 7, 8:
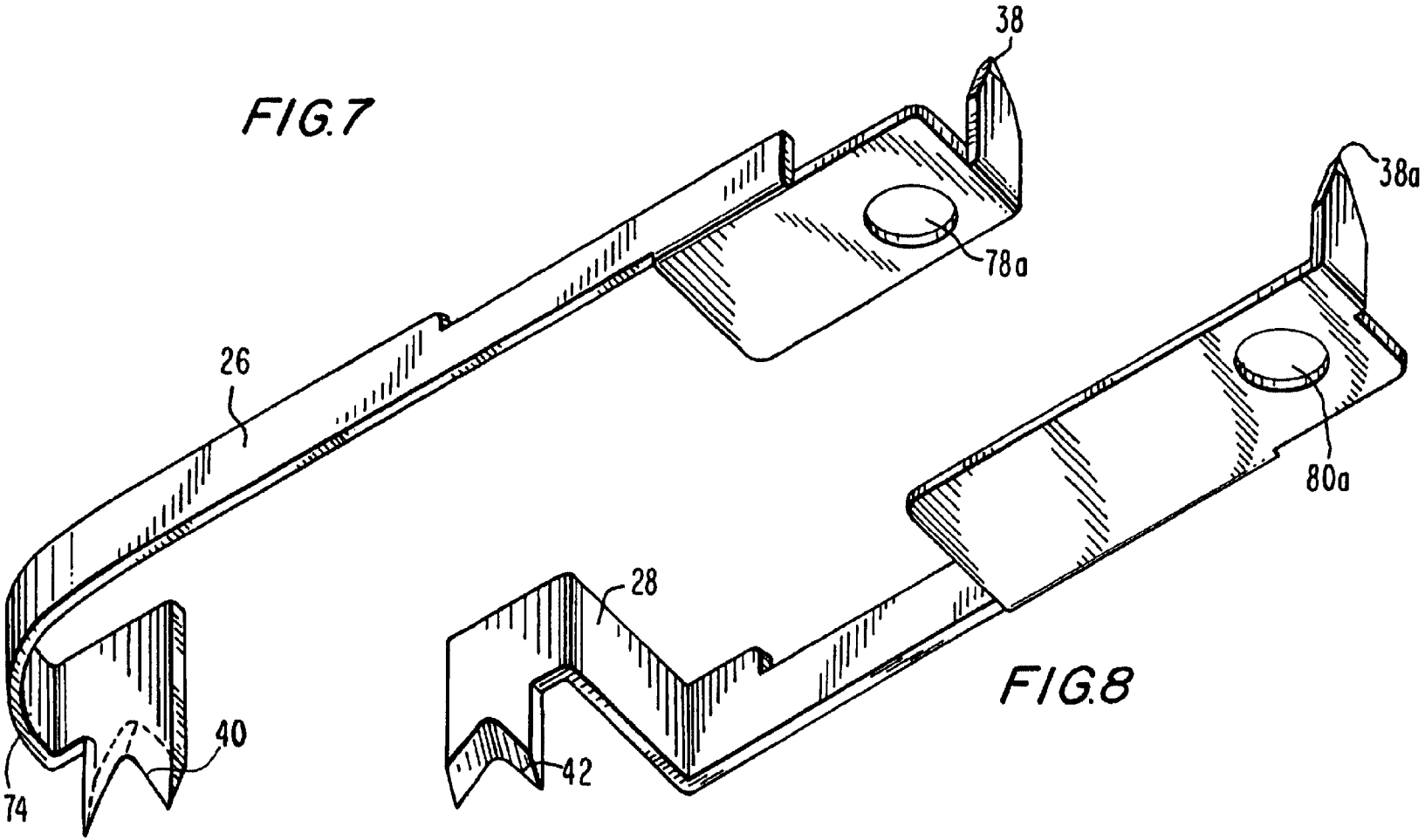
FIGS. 7 and 8 are perspective views of the bus bars of the invention.

Referring now to the drawings, FIG. 1 shows an perspective view of the connector with the insulated main power cord end leads 10*a* and 10*b*. The base element 12 of the connector as shown in FIG. 6 has a first channel 14 which extends across the connector and is sized to receive the main power cord 20 and is provided with retaining tabs 16 and 18. Dividers 21 and 22 separate the insulated main power cord leads 10*a* and 10*b* and cooperate with central post 24 to direct the main power cord leads apart from one another in order to separately contact bus bar 26 and bus bar 28. FIG. 8 shows the bus bars without the top member 30 which is shown in FIG. 4. Slots 12*a* and 12*b* are provided in the base member 12 to allow for attachment to a support using conventional fasteners.

Figure 3:
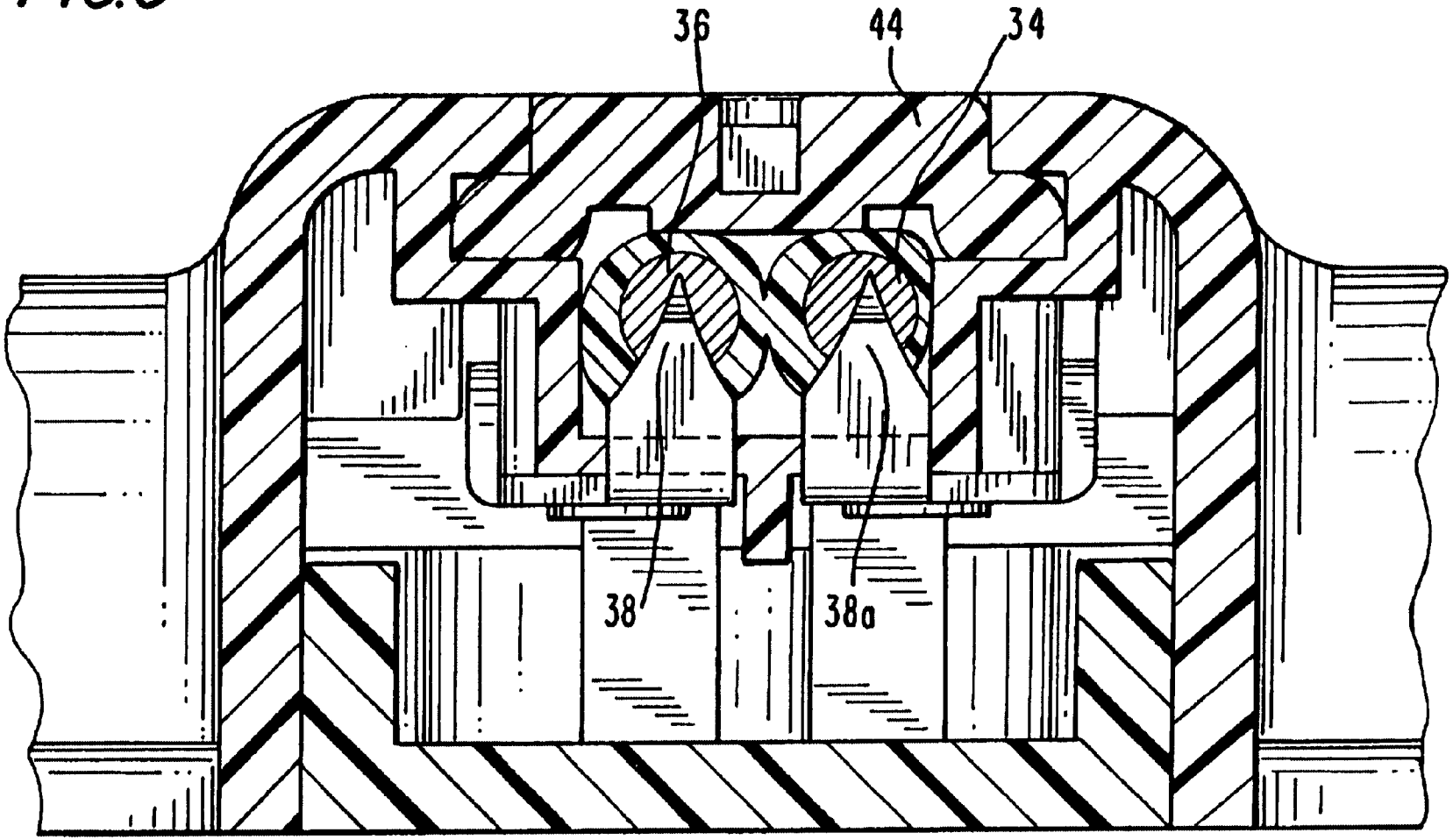
FIG. 3 is a cutaway view of FIG. 1 along lines 3—3.

In the preferred embodiment, the bus bars 26 and 28 will be installed in the top member 30 in such a manner that they will allow for insertion of the branched circuit leads 34, 36 on top of a branched circuit lead piercing end 38 and 38*a* of the bus bar as shown in FIG. 3. When the top cap 30 is placed on the base member 12, the main circuit piercing ends 40 and 42 contact the main power cord leads 10*a* and 10*b* to make the electrical connection with the conductors by cutting through the insulation and contacting a portion of the circumference of the conductor.

As shown in FIG. 4, the base member 12 and the top member 30 are firmly held together with a screw element 38 which is fitted through a hole 40 on the top member into central post 24. The base member 30 and the top member 12 are preferably arranged so that the branched circuit and the dual lead electrical cord are at right angles to one another.

FIG. 7 shows a view of bus bar 26 and bus bar 28 which has angled piercing elements 40 and 42 and wedge shape piercing elements 38 and 38*a*. Wedge shaped piercing elements 38 and 38*a* have a pointed, wedged shaped element adapted to pierce the insulation of a branched circuit conductor with a wedge-shaped piercing element that contacts the conductor with the wedge profile transverse to the longitudinal axis of said conductor in such a manner that the longitudinal conductive wires are pushed apart.

The angled piercing elements 40 and 42 are adapted to contact the main power cord conductor and contact a portion of the conductor surface.

As shown in FIG. 3, the retainer means 44 is adapted to slide over the branched circuit conductors 36 and 34 to force them onto wedge shaped piercing elements 38 and 38*a* to cause piercing of the insulation on the branched circuit conductors and contact of the metal conductor of the branched circuit conductors.

FIG. 4 shows a tab 50 on base member 12 which is sized to mechanically engage a slot on the interior edge 52 of the top member 30 to act as a closure means to assist the screw 38 in holding the connector together. Slots 46 and 48 are provided in top member 30 to provide an opening into which are fitted, wedge shaped piercing means 38 and 38*a* of the bus bars 26 and 28, respectively.

Figure 5:
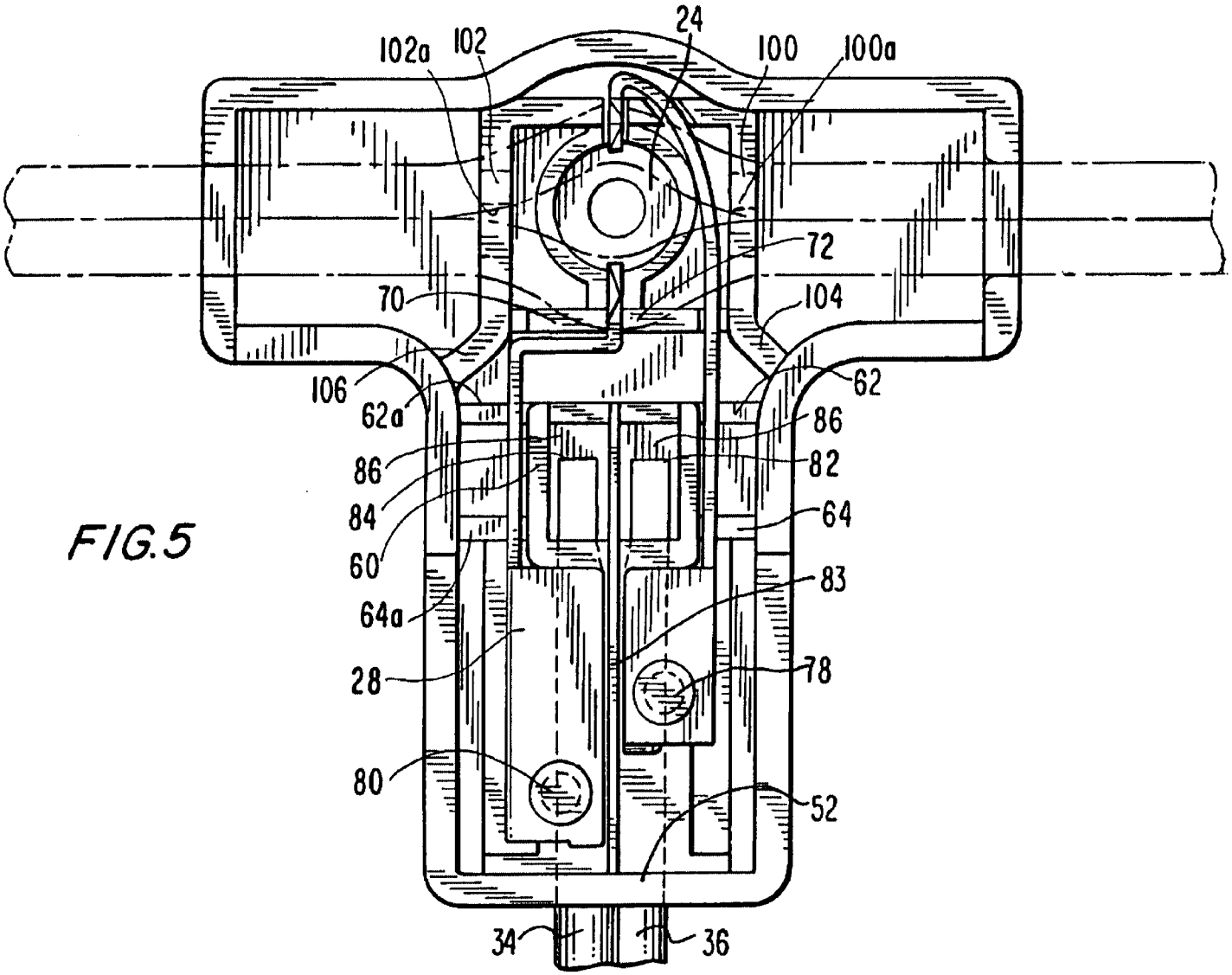
FIG. 5 is a bottom view of the top member of the connector showing the position of the bus bars.

As shown in FIG. 5, the bus bars 26 and 28 are fitted into retaining channels which are formed by spaces between central element 60 and side pieces 62 and 64 as well as side pieces 62*a* and 64*a*. Retaining wall 68 has slots 70 and 72 which hold the bus bars in alignment in cooperation with the retaining channel formed by spaces adjacent to central element 60. Bus bar 26 has a curved end 74 which is fitted into channel 76. Bus bar 26 is secured in placed with a melted plastic post 78 which is fitted into hole 78*a*. Bus bar 28 is secured in place with melted plastic post 80 which is fitted into hole 80*a*.

As best seen in FIG. 5, divider wall 83 is placed between the bus bars to prove electrical insulation and to also provide mechanical support for the bus bars. The ends 82,84 of the branched circuit cord 34,36 are shown in cavities 86,88. As best seen in FIG. 4, teeth 90 are provided at the top of openings 92,94 to engage branched circuit cords 34,36 when they are inserted into cavities 86,88. When top 30 engages base 12, posts 96,98 provide pressure on the area of cords 34,36 adjacent to ends 82,84. This provides a means which is independent of the wedge shaped piercing means 38,38*a* for holding cords 34,36 securely in the top 30. Cut out 31 provides an opening to engage the top portion of power cord leads 10*b* when top 30 is in contact with bottom 12.

As best seen in FIG. 5 arcuate wedges 100,102 have slots 100*a*,102*a* which engage the power cord 20 when top 30 and base 12 are placed together. The arcuate wedges are preferably integrally molded into ribs 104,106 in such a manner that they extend below the surface of ribs 104,106 to provide a means for applying pressure to power cord 20 to hold the power cord in first channel 14.

FIG. 6 shows slots 12*a* and 12*b* which provide attachment means to engage a conventional fastener such as a nail or screw head. In the alternative, the mounting means may comprise a pair of holes (not shown) for engaging a conventional fastener.

The foregoing description of a preferred embodiment of the invention has been presented for purposes of illustration and description. It is not intended to be exhaustive or to limit the invention precise form disclosed. Obvious modifications or variations are possible in light of the above teachings. All such obvious modifications and variations are intended to be within the scope of the appended claims.

I claim:

1. An electrical connector having a base member having a first channel for an electrically insulated dual conductor main power cord comprising dual conductors and a top member having a second channel for an electrically insulated dual conductor branched circuit power cord, the first channel comprising a first space which is adapted to confine the dual conductors of said main power cord while maintaining a second space between the conductors of said dual conductor main power cord and the second channel comprising means to hold said dual conductor branched circuit power cord transversely at an angle to said first channel, said connector also including two electrically conductive bus bars fitted into retaining means in said top member, said bus bars having at each end a piercing element adapted to penetrate the electrical insulation of said dual conductor main power cord and said branched circuit dual conductor power cord to provide an electrical connection between said dual conductor main power cord and said dual conductor branched circuit power cord; and a retainer means which is sized to engage the second channel in said top member to force said branched power cord against two of said piercing elements of said bus bars located at the ends of said bus bars to establish and maintain electrical conductivity between said main power cord and said branched circuit power cord.

2. The electrical connector as defined in claim 1 wherein the piercing element adapted to penetrate the electrical insulation of the power cord has an angled cutting edge that cuts into the insulating layer and contacts a portion of the circumference of the conductor.

3. The electrical connector as defined in claim 1 wherein said electrical connector has a longitudinal axis and a piercing element that contacts the electrically insulated dual conductor of the branched circuit, said piercing element comprising a wedge-shaped piercing element that contacts the electrically insulated dual conductor of the branched circuit with a wedge-shaped profile at an angle which is transverse to the longitudinal axis of said conductor.

4. The electrical connector as defined in claim 1 wherein the base member and the top member are fastened together by a screw fastener.

5. The electrical conductor as defined in claim 1 wherein the top member is provided with said retainer means which forces said electrically insulated dual conductors of said branched circuit conductors against said wedge-shaped piercing element.

* * * * *